US006482101B1

(12) United States Patent
Posma

(10) Patent No.: US 6,482,101 B1
(45) Date of Patent: Nov. 19, 2002

(54) METHOD OF AND APPARATUS FOR ADJUSTING LOFT AND LIE ANGLES OF GOLF CLUBS

(76) Inventor: Marinus B. Posma, 5125 Studebaker Rd., Tipp City, OH (US) 45371

( * ) Notice: Subject to any disclaimer, the term of this patent is extended or adjusted under 35 U.S.C. 154(b) by 0 days.

(21) Appl. No.: 09/525,676

(22) Filed: Mar. 15, 2000

Related U.S. Application Data

(60) Provisional application No. 60/125,159, filed on Mar. 19, 1999.

(51) Int. Cl.[7] ..... A63B 57/00
(52) U.S. Cl. ..... 473/246; 473/409; 430/945
(58) Field of Search ..... 473/409, 314, 473/245, 247, 248, 244, 324, 246; 73/1.75; 430/945; 269/86

(56) References Cited

U.S. PATENT DOCUMENTS 4,622,836 A * 11/1986 Long
4,693,479 A * 9/1987 McGwire
4,697,814 A * 10/1987 Yamada
4,875,293 A * 10/1989 Wakefield
5,467,991 A * 11/1995 White
5,788,582 A * 8/1998 Shapiro
5,848,941 A * 12/1998 Morra
5,848,944 A * 12/1998 Brannen
5,870,815 A * 2/1999 Karner
5,924,934 A * 7/1999 Hamilton
5,974,645 A * 11/1999 Currie
6,227,982 B1 * 5/2001 Wurster

FOREIGN PATENT DOCUMENTS

JP 60-79206 * 5/1985

* cited by examiner

*Primary Examiner*—Stephen Blau

(57) ABSTRACT

To adjust loft and lie angles of golf clubs, a laser beam projector is mounted coaxially in a bore of a golf club head hosel, a laser beam projected, and the hosel is bent in a single direction until the beam aligns with a target or mark placed on a fixed surface which has a predetermined relationship to a clamp for the club head. Each club head is clamped in a predetermined position relative to its face and sole and the clamp is mounted in a predetermined relationship relative to the target surface. The target is arranged coaxially with the desired end position of the hosel axis. The projector is mounted in the hosel bore by means of an expanding collet which is inserted into and then snuggly aligned internally and coaxially in the hosel bore. Depending on the direction and the amount the projected beam is misaligned from the target, a hosel bending tool is placed on the hosel and the tool is moved in a single motion and direction opposite to the misalignment direction until the projected beam and target are brought into the desired end alignment. Multiple targets related to each club may be used to achieve standard, high or low trajectory loft from a set of clubs according to the desires of a particular player.

4 Claims, 3 Drawing Sheets

METHOD OF AND APPARATUS FOR ADJUSTING LOFT AND LIE ANGLES OF GOLF CLUBS

This application claims the benefit of U.S. provisional application No. 60/125,159, filed Mar. 19, 1999.

This invention relates generally to a method of and apparatus for producing a set of harmonized golf clubs by precisely varying the loft and lie angles of the faces and soles of club heads relative to the hosels of golf clubs, and in particular it relates to a laser beam projection method and system that enables a manual bending adjustment of a nominally-ductile hosel to be made in a single direction for both loft and lie with a greater degree of accuracy and speed of operation than heretofore possible.

BACKGROUND OF THE INVENTION

The typical amateur golfer, when purchasing golf clubs for the very first time and with little or no golfing experience or equipment knowledge, usually buys clubs as produced to the club manufacturer's specifications. These standards include different loft and lie angles for each club of a set, according to years of common practice and experience. Even if purchased from a reputable shop which has a golf professional available to assist the purchaser, much is left to guesswork as to the particular player's loft and lie needs, since his or her capabilities or potential for the sport are unknown. The buyer's height is often taken into consideration so that the club head sole of a particular club will be placed on the ground the necessary distance forward of the player's toes when both hands are placed on the club grip and the person is in the proper stance and position to make a swing.

Clubs are typically manufactured so as to fit their lengths to an average-height individual. If the purchasing amateur is shorter than average, the butt ends of the clubs may be shortened and the clubs regripped. Alternatively, the seller may just advise the player to grip the clubs further down on the shafts to effectively shorten the clubs, but without the expense of trimming their lengths. If the player is considerably taller than average so as to make standard clubs insufficient in length, longer clubs may be specially ordered directly from the manufacturer. In either event, the typical club purchase by an amateur or beginner often results in no variation being made to the loft or lie angles of the clubs. They are sold "as is", with the player accepting the standard loft and lie angles designed into the clubs by the original manufacturer, even though manufacturing tolerances and known equipment for setting the angles may provide clubs which are out of tolerance as much as one or two degrees from what they should be for a given individual.

For superior golfers, however, and in particular for playing professionals, it is common to fit each player as precisely as possible for both their preferred lie angle and loft angle of each club. To achieve this, the sole of the club, i.e., its lowermost forward edge at the bottom of the club head face, should be essentially parallel to the turf or a flat surface at ball address. If an imaginary sole line is extended along the sole toward the player, the lie angle of the club can be determined between that imaginary line and the shaft axis of the club. If the sole tends to incline in either direction from essentially parallel with the surface when the player is at proper ball address, the hosel of the head of each club should be bent slightly to accommodate the player. The amount of lie angle for each club will be in accordance with a well-established formula, the angle gradually decreasing from the shortest to the longest club of the set. The club heads are made from a metal which has only nominal ductility but is capable of allowing a few degrees of hosel bending without adversely affecting the integrity of the head. Typically, the allowable bending range for the lie angle is from the manufacturer's hosel preset angle to within plus or minus two degrees from the hosel axis, or four degrees overall. After the lie angle of all clubs of the set have been adjusted to the player, most club assemblers do nothing more, relying on the manufacturer's built-in loft-angle design to provide for the standard ball trajectory as a ball is struck by the particular club. Loft angle is determined between the intersection of a first plane coinciding with the club face and a second plane passing through both the imaginary sole line and the axis of the club shaft or hosel. Ordinarily, the loft angles are left intact when clubs are sold to an amateur, and are often left untouched even for better, low handicap players. For professional golfers, the loft angles may be adjusted by hosel bending to provide for higher or lower ball trajectory than standard.

The loft angle of a No. 1 iron, as manufactured, may be between twelve and fourteen degrees, while for a lob wedge, the loft angle may be as great as fifty-eight to sixty-two degrees. Manufacturers normally select a mid-point of the allowable hosel-bending range and provide for varying the loft angle plus or minus one degree from the mid-point. Thus, the loft angle of a No. 1 iron as manufactured may average thirteen degrees and for a lob wedge may average sixty degrees. The loft angles of the No. 2 iron through the sand wedge are progressively increased, as is well understood in this art.

In instances where clubs are "tailored" to fit both the desired loft and lies angles for a particular player, the lie angles are determined by arbitrarily selecting the correct club length for the player's height via getting the player to take a stance at address of a ball with a mid-iron of a set. If the sole of the club is parallel to the ground, the manufacturer's standard lie angles are most likely correct for the entire set. If not parallel, the lie angle should be measured and the hosel bent according to the particular individual. All other clubs of the set must then be bent according to the known formulated normal lie angle variation from club to club.

Loft angles may be adjusted differently from one player to another, depending on whether the player prefers to obtain a lower ball trajectory for maximum distance, or a higher trajectory for greater control, but lesser distance.

It has been said that some club manufacturers use lesser loft angles for a given-numbered standard club to cause the unsuspecting amateur to incorrectly think that the manufacturer's clubs are superior because they allow the player to hit the ball further than the same-numbered club of another manufacturer. For the most part, however, the loft angles are generally within the same range from one manufacturer to the next. If, however, a particular player wants a "stronger" loft angle to obtain greater distance for a given club, the loft angle can be decreased and the ball distance increased accordingly. On the other hand, if a "weaker" loft angle is desired to gain higher ball trajectory while sacrificing some distance for a given club, the loft angle can be increased. Typically, most clubs as they arrive at the retail golf shop from the club manufacturer allow for the aforementioned four degree (+ or −2 degrees from normal) lie angle adjustment and a two degree (+ or −1 degree from normal) loft angle adjustment. Both adjustments are ideally measured from the axis of the hosel or shaft, and bending is done at right angles. But, because angles are most commonly measured with the shaft already in the club head, a side of the shaft becomes the gauging line. Some shafts are tapered along the gauging surface, presenting a further measurement inaccuracy problem. A secondary problem can also result from the way club heads are made. They typically have the shaft-receiving hosel hole cast in them at the time the raw club head is made, and are the holes are then drilled and/or reamed. Obviously, if any one of the casting, drilling or reaming processes causes the hole to be even slightly off line in the hosel; that will affect the shaft angle relative to the club head, in either loft, lie or a composite of those two angles. This has the capability of providing an inaccurate loft and/or lie angle of the finished club, possibly by as much as several degrees between the club head and the grip.

To obtain an adjustment of either the loft or lie of a club, several known tools and some automatic machines are known and in common use in the industry. One such manually-operable tool is known as the Steelclub unit manufactured by Mitchell Golf of Centerville, Ohio. It comprises a clamp having separate loft and lie angle-gauging protractors associated with the clamp. The clubs must be shafted at the time of adjustment and a side of each shaft is utilized for alignment purposes. See, for example, U.S. Pat. No. 4,620,431 issued to Douglas Muldoon on Nov. 4, 1986, which illustrates this general type of clamping and protractor-gauging structure. With meticulous care and with non-tapered shafts at the points of alignment with the protractor markings, such devices can be used effectively for adjustment to an accuracy of about one-fourth of a degree. The problem occurs in that the loft and lie angles are adjusted by bending the hosel separately at right angles for each the loft and lie. Oftentimes an adjustment which has been made for loft will adversely affect the lie angle, and vice versa. Depending on the accuracy desired, each of the two angles may have to be readjusted multiple times, measuring the other angle each time after the hosel has been bent for one angle.

At least one automatic machine for varying loft and lie angles is known in the prior patent art. It is done at the club manufacturing level and is illustrated in U.S. Pat. No. 4,622,836, assigned to McGregor Golf Company of Albany, N.Y. The '836 patent issued on Nov. 18, 1986 to Dabbs C. Long et al. It shows a rather complex and presumably quite expensive machine in which a shaftless club head is clamped in a position with its hosel bore facing vertically upwardly. A pin is inserted into the machined bore of the hosel and electrical signals determine any angular deviation of the pin from the desired true vertical position. Any measured deviation is then used to activate an appropriate one or two of four hydraulic rams horizontally against the hosel to bend the hosel and thereby restore the bore axis in the desired location for the given club. An objective is to allow scrapping of a club head if it is not manufactured correctly within the specified tolerances. This allows the scrapping to be done before rather than after the head and the shaft have been connected, as a cost-reduction measure. The complexity and cost of the machine would appear to make its usefulness limited only to club manufacturers, and not be practical for the small basement or garage shop that buys club components and builds them for particular golfers or for themselves. Nor would it appear practical for the larger retailer of golf equipment that also repairs clubs.

SUMMARY OF THE INVENTION

The invention contemplates using a laser beam projector mounted preferably in a drilled or reamed bore or hole of a golf club head hosel and bending the hosel in a single direction until a projected beam aligns with a target mark placed on a fixed surface which has a predetermined relationship to a clamp for the club head. Each club head is clamped in a predetermined position by means registering the head to at least one surface of a clamp. The clamp itself is mounted in a predetermined relationship relative to the target surface. The target mark is aligned coaxially with the desired end position of the hosel axis while in the clamp. In a preferred form of the invention, the laser beam projector is axially aligned with the hosel bore by means of an expanding collet which is inserted into and then snuggly mounted internally in the hosel opening. Depending on the direction and amount the projected laser beam is misaligned from the target, a hosel bending tool is placed on the hosel and the tool is moved in a single motion and direction until the projected beam and target are brought into alignment.

It is a principal object of the invention to provide a simple, inexpensive, easy-to-perform system and method for adjusting either or both the loft and/or lie angles of a golf club head relative to the hosel axis in the club head in order to achieve harmonization of a full set of golf clubs.

A more specific object is to utilize the bore of a club head to predetermine the axis of the hosel as the preferred means.

Another object is to provide for accomplishing the foregoing objective in a single direction and motion of a hosel-bending tool.

A further object is to enable the foregoing objectives to be accomplished before the shaft has been affixed to the club head during the club manufacturing process.

Yet another object of the invention is to provide an apparatus which is simple and of nominal capital cost so as to be economically available to small golf club shops which assemble shafts to club heads.

A further object is to provide for accomplishment of the foregoing objectives through use of a simple, highly accurate low cost laser beam projector.

Other objects an advantages will become apparent from the following description, in which reference is made to the accompanying drawings.

BRIEF DESCRIPTION OF THE DRAWINGS

FIGS. 7A and 7B illustrate a target and laser beam mark before and after bending of a hosel from which the laser beam is projected, respectively.

DESCRIPTION OF THE PREFERRED EMBODIMENT

Figure 1:
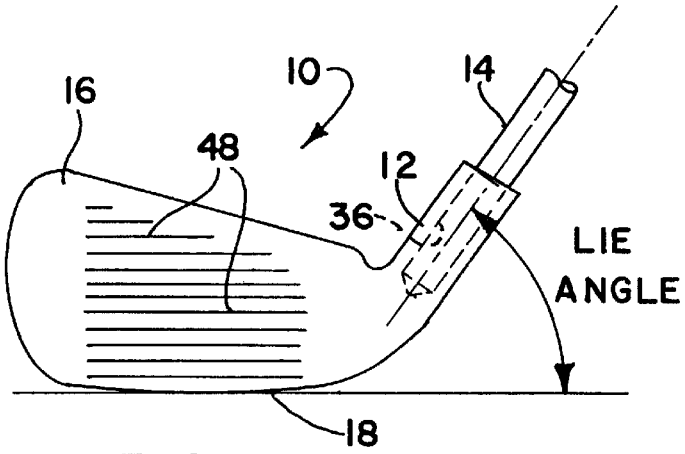
FIG. 1 is the face of a golf club head with its sole resting on a flat surface to depict its conventional lie angle relative to the surface.
Figure 2:
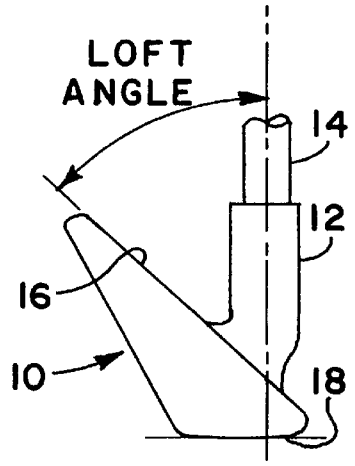
FIG. 2 illustrates a view from the left of FIG. 1 to depict the loft angle of the club.
Figure 3:
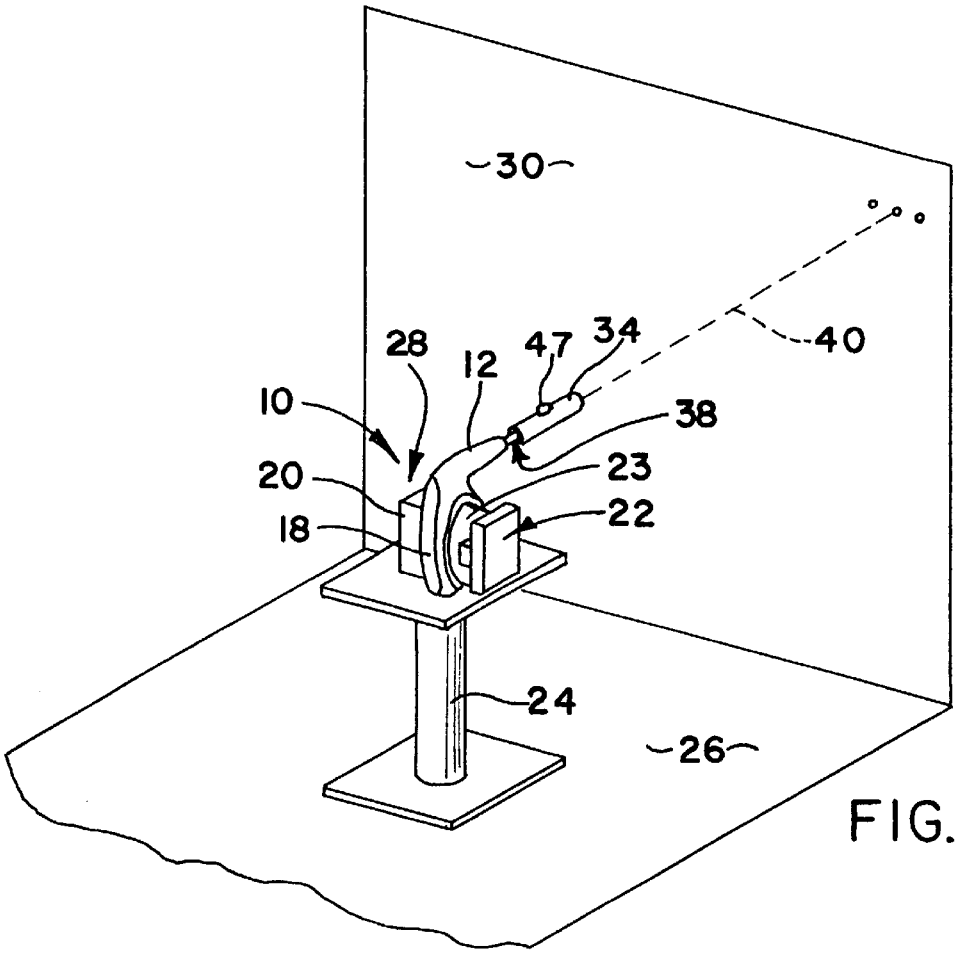
FIG. 3 is a simplified isometric view of a clamp for mounting and registering the club heads therein and projecting a laser beam onto a wall containing one or more targets with which the beam is to be aligned.
Figure 5:
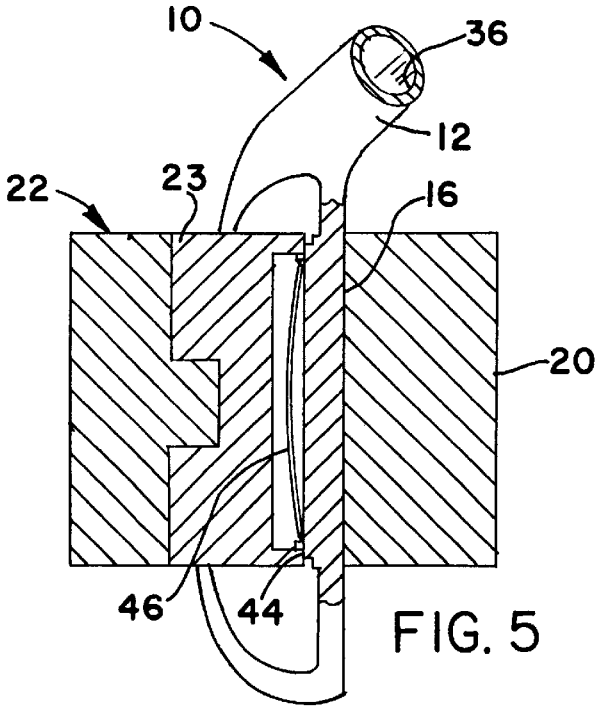
FIG. 5 shows utilization of the element of FIG. 4 to properly register the club heads in a predetermined position in the clamp.
Figure 6:
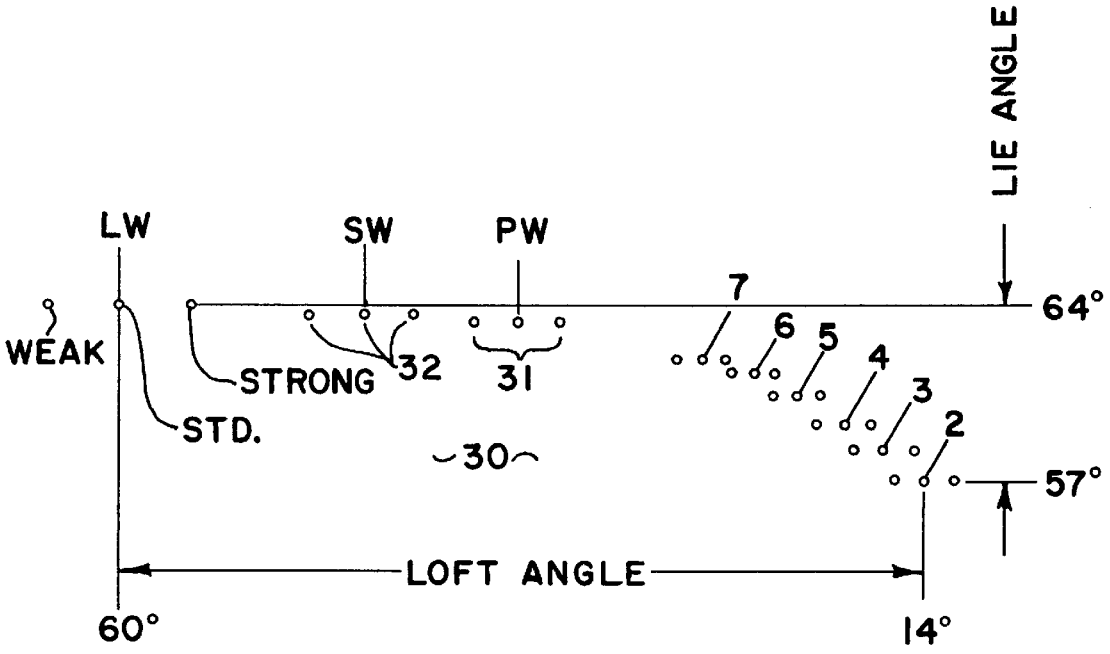
FIG. 6 shows one form of chart for positioning a plurality of targets on a surface such as a vertical wall, the plurality of targets representing a set of irons of a full set of clubs.
Figure 8:
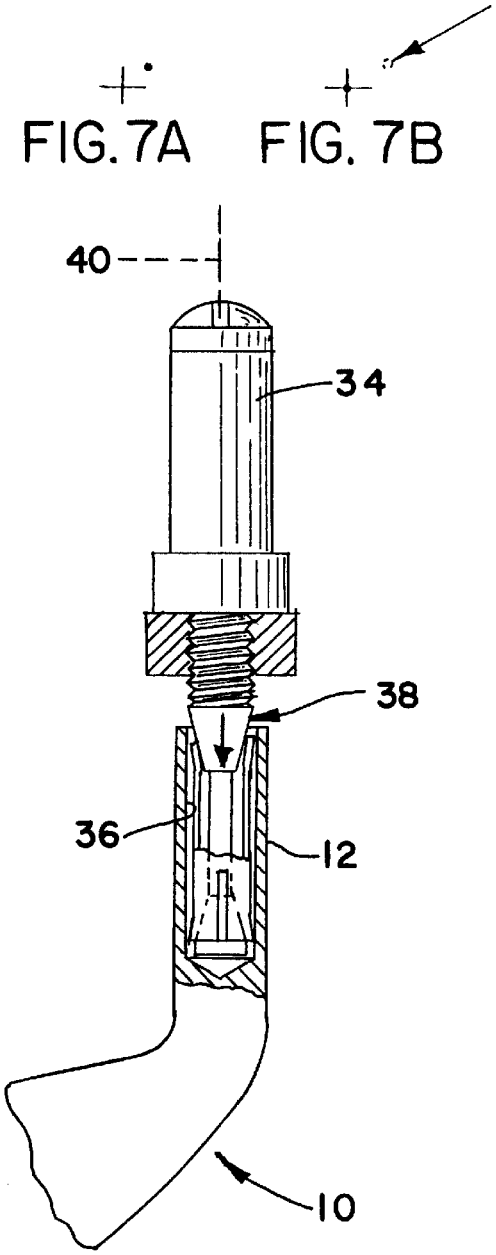
FIG. 8 is a fragmentary view of one conventional type of means for mounting a laser beam projector in a bore of a hosel.

FIGS. 1 and 2 are presented herein primarily as background to illustrate golf club loft and lie angles respectively, the measurement and adjustment of which are the subject of my invention. Although the difference between loft and lie is well known amongst club manufacturers, repair persons, retailers and others whose livelihood or strong interests are associated with golf, golfers themselves often confuse the two angles. FIG. 1 shows a club head 10 having a hosel 12 and a shaft 14 protruding upwardly from the hosel. The shaft itself is not a part of my invention and will not be described further herein, except to illustrate how the prior art technique of measuring and adjusting loft and lie angles is dependent on two sides of the shaft as the base for accomplishing the objectives. The head 10 has a flat face 16 and a sole 18, which is slightly curved although it may be described herein at times as being a line. The clubs illustrated are known as "irons", while the remaining clubs of a set are typically referred to as "woods". While woods are convex-faced, and while they normally do not having elements for mounting logos such as what will subsequently be discussed in connection with FIGS. 4 and 5, it should be understood that the laser method of adjusting loft and lie angles is equally applicable to woods with appropriate changes being made because of the different shapes of the heads. Within a full set of clubs having both irons and woods, the clamping elements or members 20 and 22 of FIGS. 3 and 5 will require changing to accommodate the difference between woods and irons. As that is believed obvious to do after having had my invention herein described, it will not be described in detail. Both woods and irons have hosels 12 with the only known exception being one brand of clubs that has woods in which the shafts are mounted directly to heads which lack hosels. For that reason, only irons will be illustrated and described herein. It should also be understood that while I prefer to provide a harmonized full set of clubs from a high lofted lob wedge through a low lofted wood, the term "full set" as used herein can mean less a complete set normally carried in a golfer's bag, the full set including either irons or woods alone. Referring now to FIG. 3, a stand 24 is provided on a floor 26 to support a clamp 28 for mounting the heads 10 between the clamp jaws or elements 22 and 20. A wall or other surface 30 is related a predetermined distance from the clamp 28 and is provided with a field 31 of three marks or targets 32 which are placed on the wall in precise relation to registering mechanism associated with the clamping elements. Each field 31 is made up of a central "standard" target, a"strong" target to its right and a "weak" target to its left. The strong and weak targets are 1.5 degrees different in loft angle from the central or standard target. For the lob wedge, e.g., a standard loft angle is 60 degrees, a strong loft angle would be 58.5 degrees and a weak loft angle would be 61.5 degrees. Thus, when a head 10 is mounted between the clamping elements in register therewith, the axis of the hosel 12 should be within a few degrees of the standard target 32 of its field for that particular club head. FIG. 6 illustrates an array of fields of three targets each for a complete set of irons from a 2 iron through a lob wedge, showing how the hosels for each club will align with different target fields. The standard loft angle targets 32 of each field are spaced horizontally between 14 and 60 degrees for a full set of irons, and the lie angle targets are spaced vertically between 57 and 64 degrees. The distinction between weak and strong as referred to herein is that a player who likes greater ball distance and less ball trajectory height for a given club may chose strong loft angle clubs, while another player who prefers higher trajectory and is willing to sacrifice distance from a given club may chose the weak loft. The approach of providing the loft field for each club enables greater refinement and truer harmonization of a club set for superior players. Although the surface 30 is preferably flat, it can be curved and it can be other than a wall.

A conventional low cost, simple laser beam projector 34 is arranged to be coaxially mounted in a bore 36 in the hosel 12 by means of an expanding mandrel or arbor 38 so that the projector can be energized to project a beam 40 from the club head toward the targets 32 on the surface 30. The mandrel 38 may be substantially like those used for gunsight alignment to a rifle. In the latter art, the arbor is placed into the barrel of the rifle, expanded to internally grip the bore, the coaxial laser beam projected to a remote surface and the sight adjusted to place the laser dot in the cross-hairs of the rifle. One such device is the Beamshot unit manufactured for Applied Laser Technology of Pasadena, Calif.

In its broadest aspects, the term bore is also intended to include a projection extending from the hosel, since at least one club manufacturer is believed to mount its hollow shafts over a pin rather than into a bore. It would be an obvious expedient to mount the laser beam projector 34 on such a pin and is considered within the scope of my invention.

Figure 9:
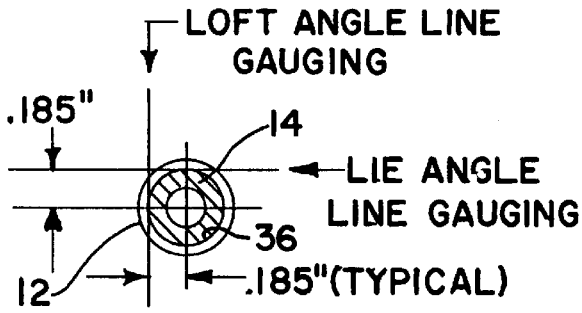
FIG. 9 shows the prior art method of determining the loft and lie angles from the sides or edges of the shafts of a set of clubs, with a shaft being shown in cross-section.
Figure 10:
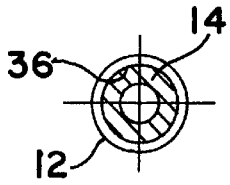
FIG. 10 is a view similar to that of FIG. 9, illustrating that it is the axis of the shaft rather than two perpendicular sides of the shaft that are utilized in this invention to measure and establish loft.
Figure 11:
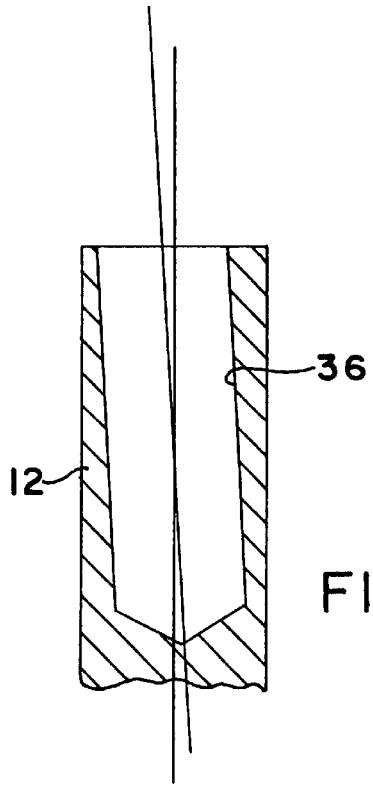
FIG. 11 is an enlarged view of a hosel and its bore in cross-section, thereby illustrating in greatly exaggerated form a potential for problems when using the prior art techniques of FIG. 9 for measuring loft and lie angles from the sides of a shaft.

Ordinarily, the bores 36 are made directly into the hosel when the heads are cast, and are then drilled and/or reamed to provide a bore which is approximately 0.006 inches larger than the tip diameter of the shaft 14. The small clearance allows for a thin film of cement to hold the shaft in the bore. There is potential for misalignment of the bore relative to the cylindrical hosel 12 not only during the casting process, but also in the drilling and reaming process for the finished bore. A misaligned bore results in a misaligned shaft. And a misaligned shaft means that the prior art devices which measured and adjusted loft and lie angles according to the shaft sides as noted in the "Background", while theoretically still being related to the bore rather than to the cylindrical sides of the hosel, would further complicate the adjustment process. The bore misalignment can extend anywhere around 360 degrees of the hosel. Remember that the prior art loft and lie angle measurements were done at right angles along the sides of the shafts, as shown in FIG. 9. Assume for example that the bore misalignment was in the direction of the two o'clock position of FIG. 9. This translates into both a loft and lie misalignment. When one measurement is made with a protractor and compensated for, the club is placed in a different clamp and the other angle measured with a different protractor. The hosel bend is then made to compensate for that misalignment. But, if precision is desired, the first measurement should be repeated to see that the bend for the second adjustment did not adversely affect the first adjustment. The number of times this must be repeated is dependent upon the accuracy desired and the amount of misalignment present in the shaft as a result of a misaligned bore. Another factor also enters the equation, and that is the type of shaft being gauged. Some shafts are parallel adjacent the club head, some are tapered and most commonly especially in steel shafts, the taper is the result of steps between different-diameter portions of the shaft. Since the sides of the shafts are the gauging lines in the prior art, not only is the gauging line offset from the true axis of the bore, but the problem can be further compounded by virtue of the gauging line being out of parallel with the shaft axis in all but those shafts which are parallel for some distance beyond the distal end of the hosel.

Practice of my invention not only avoids the problems attendant with the potential problems of the axis-offset gauging of the prior art, but it also allows a single direction bending motion of the hosel to compensate for both lie and loft misalignment simultaneously. No right angle two-step clamping and gauging process is required. If a laser beam spot or dot 42 is off from the target 32 to the upper right as shown in FIG. 7A, the conventional bending tool (not shown) can be manually moved to bend the hosel until the dot 42 is moved from the dotted to the full position as shown in FIG. 7B. One motion is all that is required, and that motion is directly related to the direction the dot is off in relation to the target.

Figure 4:
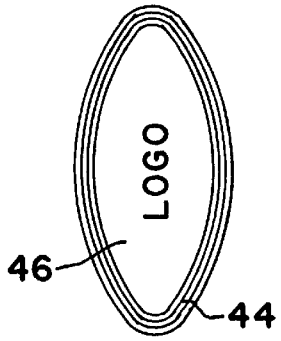
FIG. 4 illustrates a logo mounting element on the back of a club head, which element may be one form of device for registering individual club heads in the clamp of FIG. 3.

Because the club heads must be accurately mounted in the clamp 28, some means must be provided on all clubs in the exact same relationship to the club face 16 and sole 18. I prefer to utilize a boss 44 provided in a cavity at the back of the irons. It may be of any shape, and the one illustrated is oval as seen in FIG. 4. A recess within the oval becomes a seat for a medallion 46 which carries the manufacturer's logo. As can be seen in FIG. 5, the clamping element 22 has a removable portion 23 that is recessed so as not to contact the medallion during clamping. The outer edges of the portion 23 conform closely to at least one of several ridges around the boss so that the ridges seat within the recess of the portion 23. Either element 20 or 22 can be movable toward the other for clamping between the face and ridges to secure the heads in the clamp. Preferably after the clamping, the mandrel 38 which is secured to the laser projector 34 is inserted into the bore 36 and expanded, and a battery within the projector is energized by means of a switch to cast the beam 40 toward and onto the surface 30 containing the target.

FIG. 3 illustrates but three targets, all relating to the loft of the same-numbered club. The center one of the three targets represents the standard loft for that given club, and if a standard loft is preferred, any misalignment is simply handled in the manner described in connection with FIGS. 7A and 7B with the center target. If a particular player prefers either a strong or a weak loft, however, the laser beam dot is moved to one of the outer targets. The right target is for obtaining the stronger or low trajectory ball flight, i.e., achieving more distance with that club than standard. If a higher trajectory ball flight is desired, the weaker loft target is selected, i.e., the one on the side of the standard target opposite the stronger loft target. Because of the inherent accuracy of laser adjustment of the loft in direct relation to the axis of the hosel or its bore, I am able to finely tune club loft to whatever a particular player desires. I can obtain accuracy of alignment within one-fourth of a degree, sometimes less.

The chart of FIG. 6 would normally be used by a club maker other than a large club manufacturer. It covers the entire range of a set of irons from the 2 iron down through the lob wedge, or any subset in between. A high production set-up would have perhaps a single set of targets like in FIG. 3 for each different club of a set, e.g., one station adjusting nothing but 6 irons, another doing 5 irons, etc. This allows for focusing on only a single or a single field of three targets.

Obviously, something comparable to the registering oval ridges of FIG. 4 is required, and it must be precise on all club heads in relation to the face and sole. Since different manufacturers would have different registering elements to fit the clamp, the portions 23 must be replaceable in the clamp 28 for accommodating these differences. The registering elements can even be the grooves 48 or scribe marks on the faces or edges of the clubs, provided they are commonly located on all heads. If three points on the perimeters of all club heads can be positioned in the same relationship to the faces and soles, a three-point register system including one or more elements or marks can also be employed in the clamp 28.

Various other changes can be made without departing from the spirit and scope of the claims.

I claim:

1. The method of checking the loft and lie angles of an inwardly-directed cylindrical bore in a hosel of a metal golf club head relative to a ball-striking face and a sole of said club head to enable varying at least one of said angles in the event said hosel bore is misaligned from a desired end loft or lie angle; comprising the steps of:

providing at least one target on a surface;

clamping said club head in a predetermined location and position to aim the axis of the hosel bore generally at said target;

providing a laser beam projector on one end of an expanding mandrel in a coaxially-aligned relationship with said mandrel;

inserting the end of said mandrel remote from said projector into said bore while said mandrel is contracted to a diameter smaller than said bore and thereafter expanding the mandrel to snuggly fit said bore;

activating said projector to direct a laser beam from said projector at said target; and, in the event said beam and target are misaligned, bending said hosel relative to said club face or sole in the appropriate direction said laser beam aligns therewith.

2. The method according to claim 1 including the additional step of providing a grouping of three distinct and laterally-aligned targets relating to the club loft angle on said surface, wherein a central one target of said targets comprises a target corresponding to a standard loft angle, wherein a target to one side of said central target represents a hosel adjustment reduction of approximately one degree of loft angle from said standard loft angle to enable creation of a stronger, lower trajectory ball flight when the hosel is bent to align the beam therewith, and wherein the target on the opposing side of the central target represents a hosel adjustment increase of approximately one degree of loft angle to enable creation of a weaker, higher trajectory ball flight when the hosel is bent to align the beam therewith.

3. The method according to claim 1 including the steps of providing a registering member on each club head of a set of club heads in identical relationship to the club face and sole of all club heads of the set; providing a series of targets on said surface, one for each different club of the set; and providing registering means on a clamping element for clamping each club head in the identical predetermined location and position as all of the other club heads of the set, whereby to produce a harmonized set of clubs having incrementally-related loft and lie angles.

4. The method according to claim 1 including the step of providing a plurality of targets on said surface, each of said targets corresponding to the hosel axis of a different club of a set of golf club irons, and further including the steps of clamping and unclamping each club head of said set in the identical location and position.

* * * * *

UNITED STATES PATENT AND TRADEMARK OFFICE

CERTIFICATE OF CORRECTION

PATENT NO. : 6,482,101 B1
DATED : November 19, 2002
INVENTOR(S) : Marinus B. Bosma It is certified that error appears in the above-identified patent and that said Letters Patent is hereby corrected as shown below:

Title page,
Item [76], Inventor, correct the spelling from "Posma" to -- Bosma --.

Column 8,
Line 34, after "direction", insert -- until --.

Signed and Sealed this

First Day of April, 2003

JAMES E. ROGAN
*Director of the United States Patent and Trademark Office*